US006457735B2

(12) United States Patent
Merino

(10) Patent No.: US 6,457,735 B2
(45) Date of Patent: Oct. 1, 2002

(54) ELEMENT FOR RETAINING THE FRONT OF A BOOT ON AN ALPINE SKI

(75) Inventor: Jean-François Merino, Epagny (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/802,973

(22) Filed: Mar. 12, 2001

(30) Foreign Application Priority Data

Mar. 29, 2000 (FR) ..... 00 04248

(51) Int. Cl.[7] ..... A63C 5/00

(52) U.S. Cl. ..... 280/607; 280/625; 280/626; 280/634

(58) Field of Search ..... 280/625, 626, 280/627, 628, 629, 630, 634, 607

(56) References Cited

U.S. PATENT DOCUMENTS

| | | | | |
|---|---|---|---|---|
| 3,529,845 A | * | 9/1970 | Kanno | |
| 3,823,955 A | * | 7/1974 | Solomon | |
| 3,876,219 A | | 4/1975 | Smolka et al. | 280/11.35 T |
| 3,909,029 A | | 9/1975 | Salomon | 280/11.35 T |
| 4,398,747 A | | 8/1983 | Bernard et al. | 280/630 |
| 4,660,849 A | | 4/1987 | Sedlmair et al. | 280/625 |
| 4,763,908 A | * | 8/1988 | Dimier | 280/628 |
| 4,902,031 A | | 2/1990 | Bogner | 280/625 |
| 5,615,498 A | | 4/1997 | Challande et al. | 36/117.3 |
| 5,639,108 A | | 6/1997 | Challande et al. | 280/639 |
| 5,702,119 A | | 12/1997 | Challande et al. | 280/625 |
| 6,092,831 A | | 7/2000 | Bauvois | 280/625 |

FOREIGN PATENT DOCUMENTS

| | | | |
|---|---|---|---|
| DE | 3335878 | * | 4/1984 |
| EP | 31740 | * | 7/1981 |
| EP | 0031740 | | 7/1981 |
| EP | 0692287 | | 1/1996 |
| EP | 0785003 | | 7/1997 |
| EP | 0914847 | | 5/1999 |
| FR | 1503847 | | 12/1967 |
| FR | 1503848 | | 12/1967 |
| FR | 1503849 | | 12/1967 |
| FR | 2138694 | | 1/1973 |
| FR | 2248062 | | 5/1975 |
| FR | 2522833 | | 9/1983 |
| FR | 2533833 | | 4/1984 |
| FR | 2722372 | | 1/1996 |
| FR | 2722373 | | 1/1996 |
| FR | 2722374 | | 1/1996 |
| WO | WO85/03451 | | 8/1985 |

* cited by examiner

*Primary Examiner*—Brian L. Johnson
*Assistant Examiner*—Bryan Fischmann
(74) *Attorney, Agent, or Firm*—Greenblum & Bernstein, P.L.C.

(57) ABSTRACT

An element for retaining a boot on a ski provided to releasably retain one of the ends of a boot by means of a jaw movable laterally on either side of a centered position aligned with a longitudinal and vertical median plane of the retaining element, and a compensating mechanism acting on the jaw or its return mechanism so as to further facilitate its opening, where the compensating mechanism includes two active elements, either of which are biased as a function of the side where the jaw moves with respect to the vertical and longitudinal median plane. The two active elements are asymmetrical with respect to the longitudinal and vertical median plane, such that the compensating mechanism is more or less active depending on the active element biased as a function of the side on which the jaw moves.

10 Claims, 6 Drawing Sheets

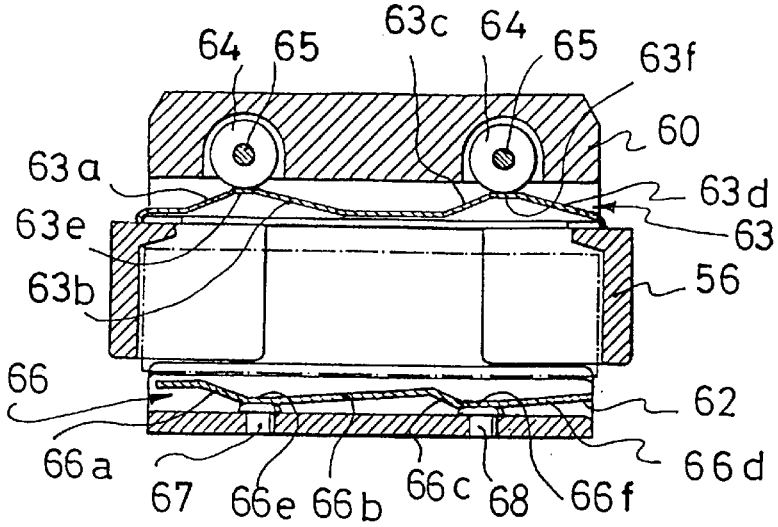
Fig. 11
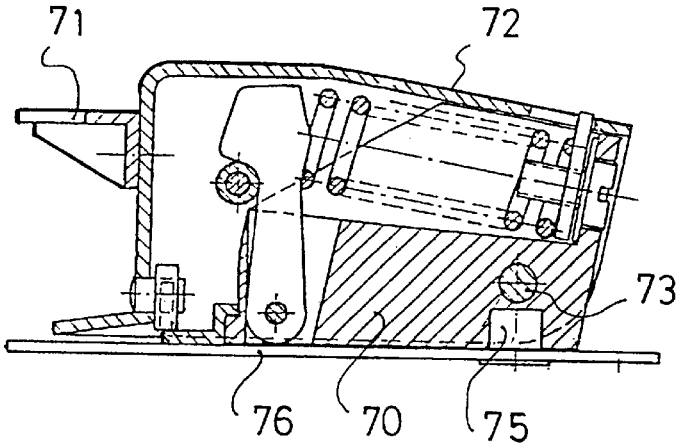
Fig. 12
Fig. 13
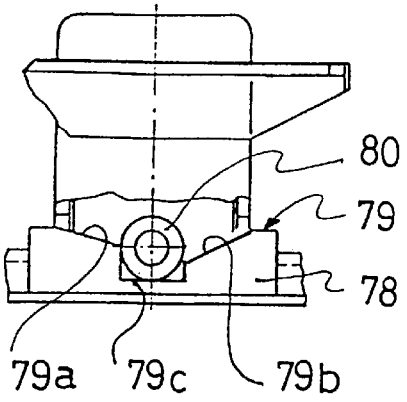

ELEMENT FOR RETAINING THE FRONT OF A BOOT ON AN ALPINE SKI

BACKGROUND OF THE INVENTION

1. Field of the Invention

The present invention relates to an element for retaining the front of a boot on an alpine ski.

2. Description of Background and Relevant Information

An element of the above-mentioned type is provided to retain the front of the boot in cooperation with a rear element, and to release the boot in the case of excessive force.

The forces exerted between the boot and the ski have a plurality of force or moment components which can be resolved in relation to axes, one of which is the vertical axis of the leg, and another is the longitudinal axis defined by the foot.

One of the main components is the moment in relation to the vertical axis of the leg. This component induces a torsion in the skier's leg, which is found at the level of the knee joint.

It has been known for a long time that the intensity of the stresses which a knee can withstand without damage depends on the direction in which the leg is biased in torsion. A knee is more fragile during a bias that drives a foot rotationally inward, i.e., toward the other foot.

Thus, a retaining element is known from the published Patent Applications Nos. FR 1 503 847, FR 1 503 848, FR 1 503 849, whose release threshold is different depending on the direction in which the boot biases it. More recently, the Applications FR 2 722 372, FR 2 722 373, FR 2 722 374 and U.S. Pat. Nos. 5,615,498, 5,639,108, 5,702,119 disclose constructions related to this problem. For these retaining elements, the release threshold is higher on the side where the knee is more resistant, and lower on the side where the knee is less resistant.

Such devices yield satisfactory results insofar as the release thresholds are better adapted to the skier's morphology.

SUMMARY OF THE INVENTION

An object of the invention is to further improve the performances of the front retaining elements in this function of adapting to the skier's morphology.

Other objects and advantages of the invention will become apparent from the description that follows.

The retaining element according to the invention is provided to releasably retain one of the ends of a boot by means of a laterally movable jaw on either side of a centered position aligned with a longitudinal and vertical median plane of the retaining element, in response to a force having a lateral component oriented in either direction against the resistance of an elastic return mechanism. It includes a compensating mechanism acting on the jaw or its return mechanism so as to further facilitate its opening, the compensating mechanism having two active elements either of which is biased as a function of the side where the jaw moves with respect to the vertical and longitudinal median plane.

The two active elements of the invention are asymmetrical with respect to the longitudinal and vertical median plane, such that the compensating mechanism is more or less active depending on the active element biased as a function of the side on which the jaw moves.

BRIEF DESCRIPTION OF DRAWINGS

The invention will be better understood from the following description, with reference to the annexed drawings that are an integral part thereof, and in which:

FIGS. 9–11 schematically show another embodiment of the invention.

FIGS. 12 and 13 relate to another embodiment of the invention applied to a rear retaining element.

DETAILED DESCRIPTION OF THE INVENTION

Figure 1:
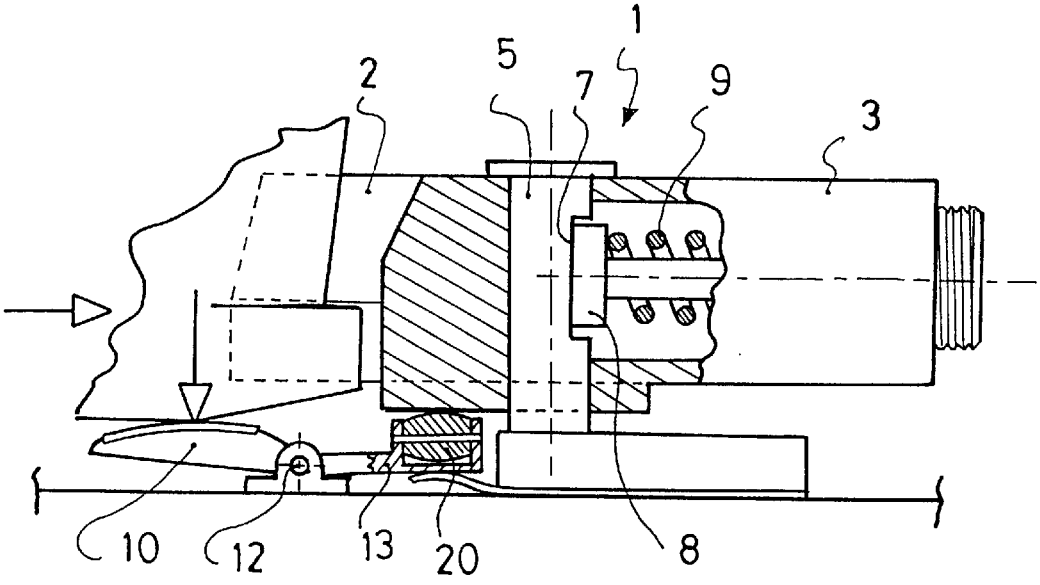
FIG. 1 schematically shows a side and cross-sectional view of a retaining element according to a first embodiment of the invention.
Figure 2:
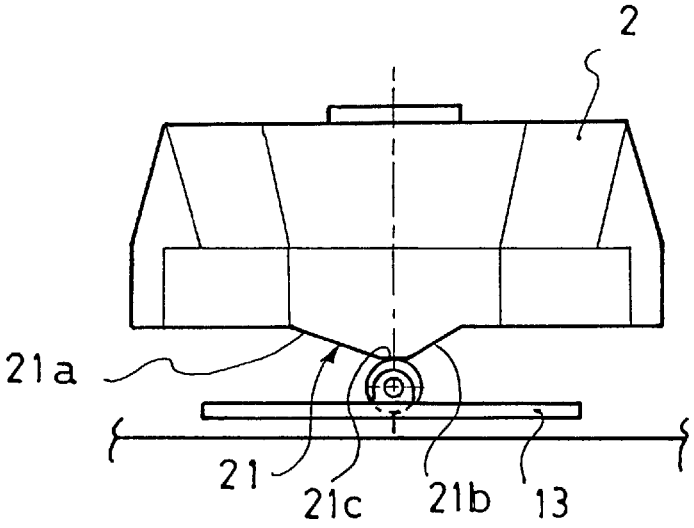
FIG. 2 is a front view of the device of FIG. 1.

The embodiment of the invention illustrated in FIGS. 1 and 2 belongs to a field of construction like that of the binding disclosed in Patent Application FR 2 533 833.

FIG. 1 shows a front retaining element 1 provided to retain the front of a boot. This element includes a retaining jaw 2 that forms an integral assembly with a body 3. The body 3 is movably mounted so as to rotate about a substantially vertical pivot 5. The pivot is provided to be affixed to the gliding board. The pivot has a flat portion 7 in its portion oriented forwardly. A piston 8 is biased by a spring 9 supported against the flat portion 7. The piston and the spring are housed in the body. In a known fashion, the piston cooperates with the flat portion to elastically return the body in a resting position that is centered on the longitudinal and vertical median plane of the retaining element, the latter containing the longitudinal axis defined by the ski. However, the jaw and the body can move away on both sides from this position against the return force of the spring 9.

A support device is further provided for the boot. This device includes a support element 10 mounted so as to oscillate about a horizontal and transverse axle 12. The support element is extended forwardly beyond its axle 12 by an arm 13 whose end is engaged beneath the body behind the pivot 5. Preferably, a roller 20 movable about a longitudinal axis is located at the end of the arm 13. When the arm is in the resting position, the support element is kept raised with respect to the upper surface of the ski due to the support of the roller 20 against the base of the body 3.

In this area, the body 3 has a ramp 21. The ramp 21 includes two lateral surfaces 21*a*, 21*b*, and a central edge or surface 21*c*.

The two ramps 21*a* and 21*b* are located on both sides of the longitudinal and vertical median plane of the retaining element, when the jaw is in its centered position, and they are oriented top down toward the edge 21*c*, which is located in the median longitudinal and vertical plane. When the body is in the centered position aligned on the longitudinal axis defined by the ski, the roller 20 is in support against the edge 21*c*. If the body pivots on either side with respect to its centered position, the roller describes either one of the surfaces 21*a* or 21*b* .

The support of the boot on the support element 10 is transmitted by the roller to the ramp, which induces on the body a lateral force that is added to the lateral force exerted by the boot on the jaw.

During a torsional front fall, in particular, this mechanism compensates for the frictional forces that exist between the boot sole and its support element, and which tend to delay the release of the boot.

Possibly, one can provide the edge 21*c* to extend along a flat portion of small width to provide a small zone on both sides of the centered position where the compensating mechanism is inactive.

According to the invention, and as is visible in FIG. 2, the surfaces 21*a* and 21*b* of the ramp 21 do not have the same gradient, such that the compensating effect is more pronounced on one side than on the other.

In the embodiment shown, the surface 21*b* located on the right side in the figure has a higher gradient than the surface 21*a*. Under these conditions, if the boot drives the jaw on the left side in the figure, a same support of the boot on the support element 10 induces a more substantial compensation on this side than on the other. This jaw pivoting side corresponds to the leg twisting direction where the knee is the most fragile.

For a pair of retaining elements associated with a pair of skis, the ramps of the front elements are symmetrically arranged with respect to one another, the surfaces with a higher gradient being inward, and those with a lower gradient being outward, considering the construction of the front element that has been described.

It must be noted that the surfaces 21*a* and 21*b* of the ramp are not necessarily rectilinear or planar. One and/or the other of the two surfaces could be concave so as to induce a certain progressiveness in the action of the compensating mechanism as a function of the lateral displacement of the jaw.

Figure 3:
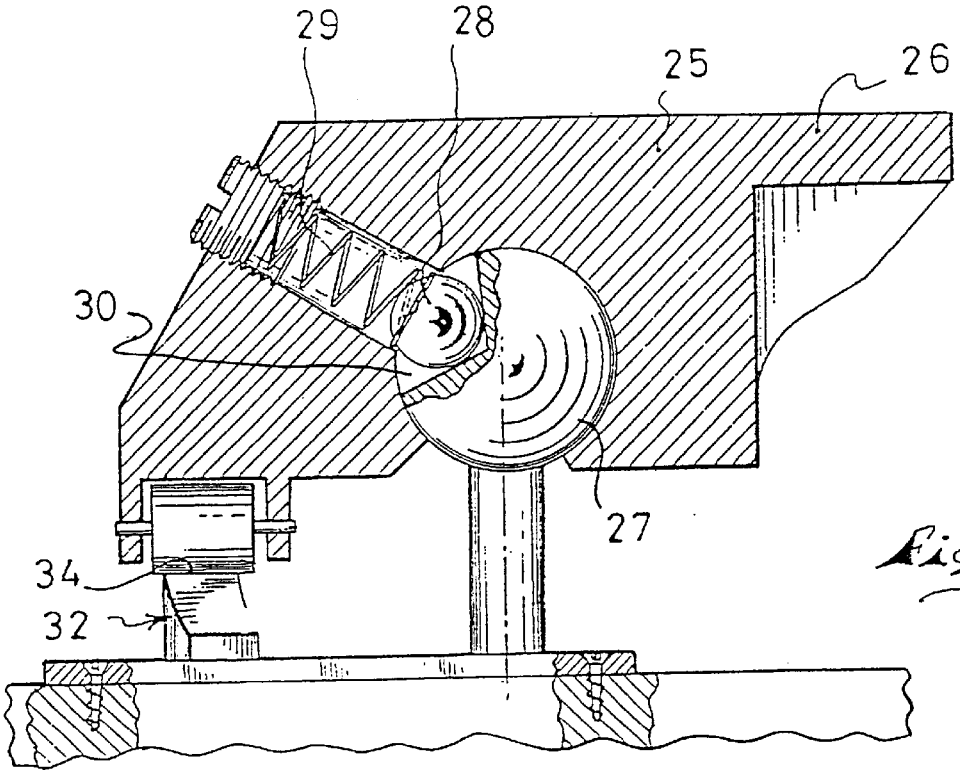
FIGS. 3 and 4 schematically show a second embodiment of the invention.
Figure 4:
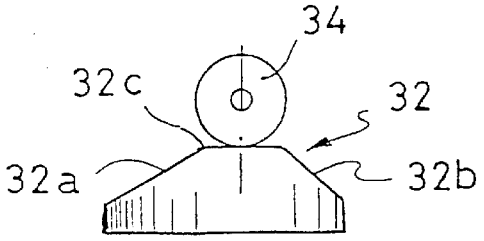

FIG. 3 shows a second embodiment of the invention. The construction shown therein belongs to a field of construction like that of the binding disclosed in Patent Application FR 2 248 062 and U.S. Pat. No. 3,909,029, the disclosure of the latter of which is incorporated by reference thereto in its entirety.

The retaining element is a front element having an integral or one-piece body 25 and jaw 26. The body is pivotally mounted on a ball-and-socket joint including a pivoting head 27 provided to be affixedly assembled to the ski and housed in the body 25. The return of the body in its centered position is ensured by a ball 28 pushed by a spring 29 back into a recess 30 of the pivoting head.

The jaw is adapted to pivot laterally on both sides of the centered position, with respect to the pivoting head. The jaw can also rise vertically as a function of the forces exerted by the boot.

The vertical movement of the jaw is controlled by a ramp 32 located at the front of the spherical head. The ramp is provided to be affixed to the ski, it includes two lateral surfaces 32*a*, 32*b* that converge base up toward a central flat portion 32*c* located in the vertical median plane of the retaining element. A rotatable roller is mounted at the front of the body 25. It rests on the ramp 32. The roller 34 could be replaced by another equivalent structure.

In the centered position of the jaw, the roller is in contact with the flat portion 32*c*. When the jaw is driven by the boot on either side of its centered position, the roller describes either one of the surfaces 32*a* or 32*b*, if the force exerted by the boot on the jaw has a vertical component in addition to the lateral component.

When the roller describes either one of the two inclined surfaces of the ramp, the vertical component which the boot exerts on the jaw is transformed in the area of the roller into a lateral component that facilitates the lateral pivoting of the body. Thus, one has a compensating mechanism that is active in a torsional rear fall. This mechanism compensates for the friction forces between the jaw and the boot sole which can delay the release of the boot.

According to the invention, the two surfaces 32*a* and 32*b* of the ramp have a different gradient, such that the compensation is more active on one side of the centered position with respect to the other.

For a pair of retaining elements associated with a pair of skis, the ramps of the front retaining elements with more substantial gradient are located toward the inside, and the ramps with lower gradient toward the outside, considering the element construction that has been described.

Figure 5:
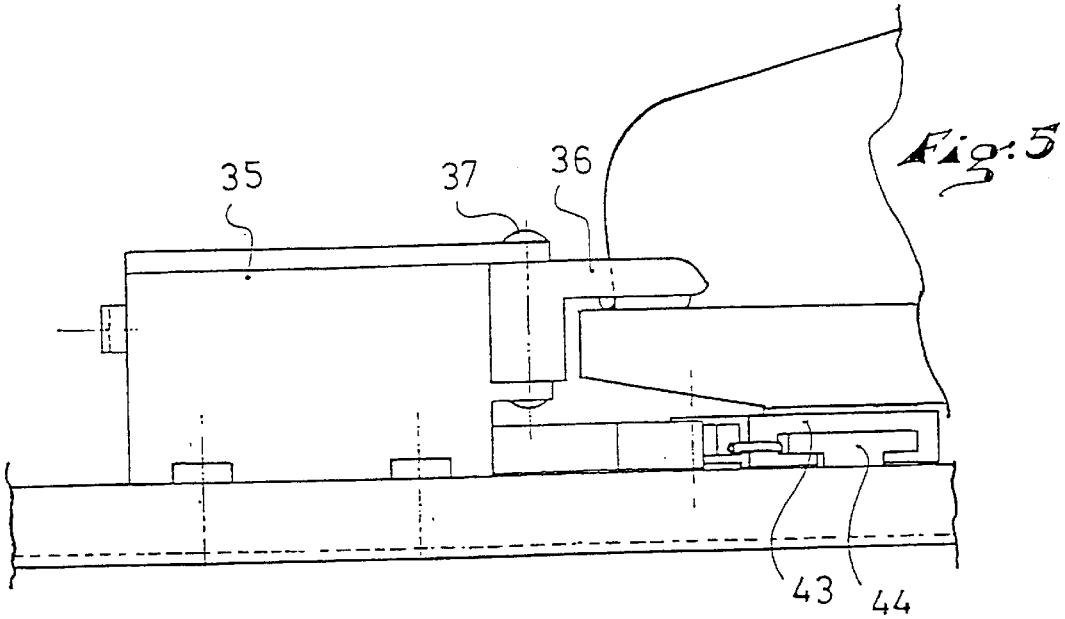
FIGS. 5–7 relate to another embodiment of the invention.
Figure 6:
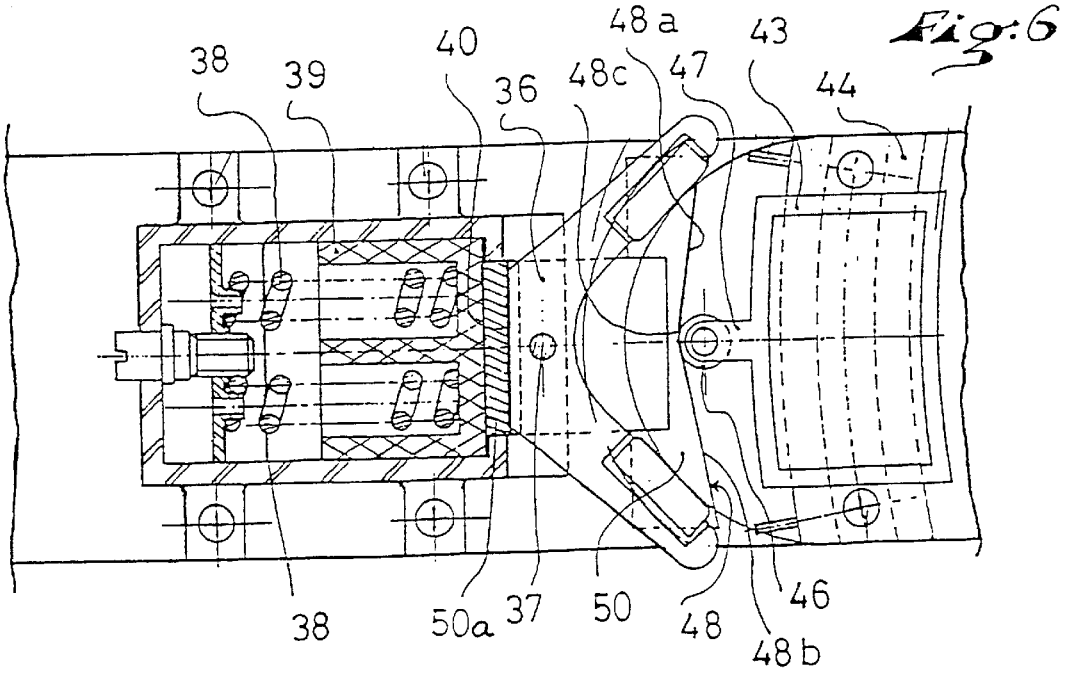
Figure 7:
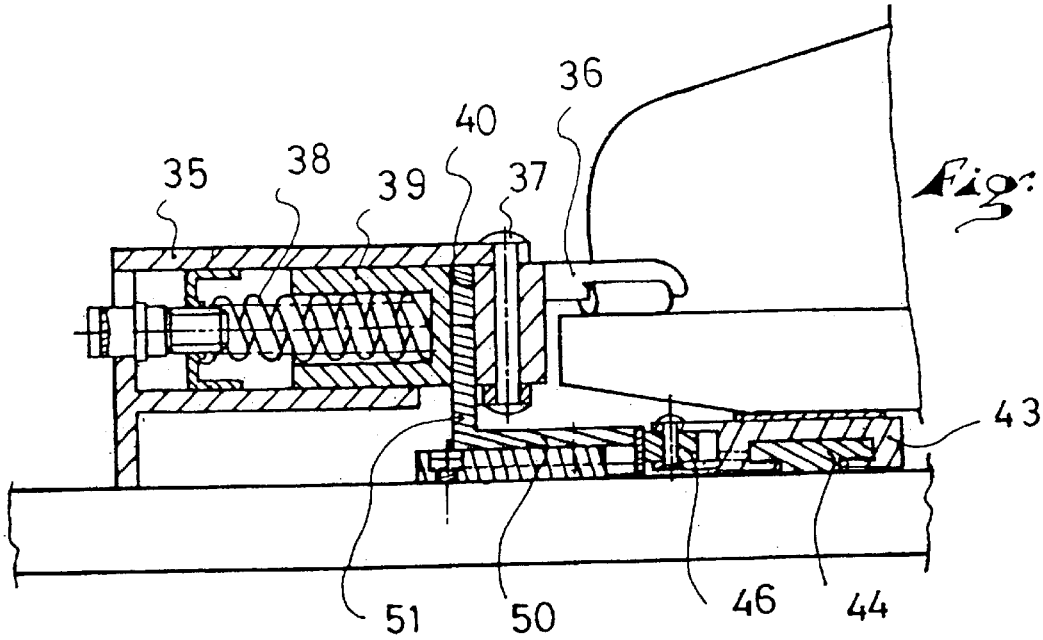

FIGS. 5–7 relate to another embodiment of the invention and, more particularly, to a field of retaining element like that described in the Patent Application EP 31 740 and U.S. Pat. No. 4,398,747, the disclosure of the latter of which is incorporated by reference thereto in its entirety.

Thus, FIG. 5 shows a front retaining element having a body 35 provided to be fixedly mounted on the ski.

A jaw 36 is movably mounted with respect to the body about a substantially vertical pivot 37.

A piston 39 and return springs 38 are housed in the body. The springs push the piston back against a flat portion 40 of the jaw located at the front of the pivot 37. The springs and the piston return the jaw 36 in a centered position on the longitudinal axis of the ski. From this position, the jaw can pivot laterally on either side as a function of the forces of the boot.

The retaining element further includes a support element 43 provided to support the boot sole. The support element here is laterally movable. To this end, according to the embodiment shown, it is guided along a rail 44 fixed to the ski. The rail can be linear and transverse or, as shown, concave along an arch of a circle centered approximately in the area of the heel of the boot so as to follow the trajectory taken by the front of the boot during a lateral release.

A roller or another equivalent structure is mounted at the end of an arm 47 that extends on the front of the support element, in the alignment of its vertical median plane. The roller is in support against the ramp 48 of an element which is in the form of a drawer 50 slidably mounted along the longitudinal direction of the ski. On the rear, the drawer-like element 50 has a return 50*a* that is inserted between the flat portion 40 of the jaw 36 and the piston 39.

The ramp 48 includes two surfaces 48*a* and 48*b* inclined front to rear, which converge toward a central edge 48*c* aligned on the vertical and longitudinal median plane of the retaining element.

In the case where the boot biases the jaw laterally, and where it exerts a substantial pressure on its support element, it tends to drive the support element along. The thrust of the roller 46 on either one of the surfaces of the ramp is transmitted to the spring in the form of a longitudinal force that proportionately relieves the force which the jaw must overcome to pivot laterally. Such a mechanism compensates for the frictional forces that exist between the boot sole and its support element.

According to the invention, the two surfaces of the ramp 48 have a different inclination with respect to the longitudinal median plane of the ski, so that the compensating system is more or less active depending on the pivoting side of the jaw. In the embodiment shown, the surface 48*a* is less inclined than the surface 48*b*. As a result, the compensation is more active if the boot drives the support element toward the top in the figure rather than toward the bottom.

For a pair of skis equipped with retaining elements, the ramps of the front elements are symmetrically arranged with respect to one another, and the retaining elements are arranged such that the least inclined surfaces are inward, and the most inclined surfaces are outward.

Figure 8:
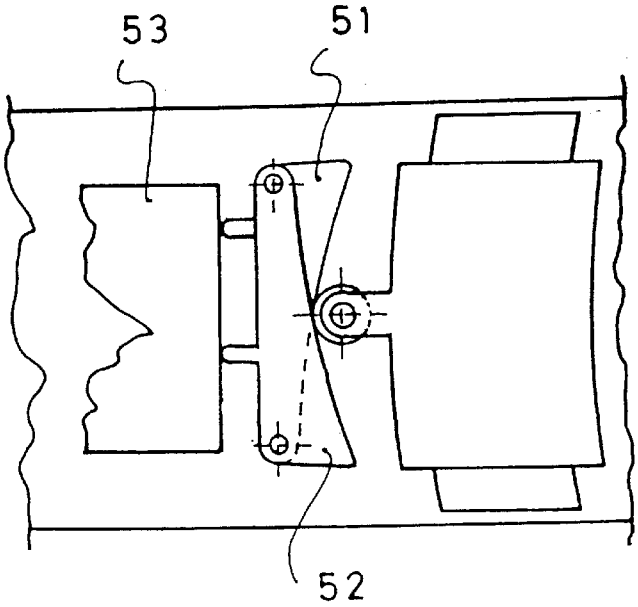
FIG. 8 is an alternative embodiment of the device shown in FIG. 6.

This embodiment is adapted to have alternatives. For example, as schematically shown in FIG. 8, rather than the ramp having surfaces of different inclination, one could have intersecting levers 51 and 52 acting on the drawer-like element 53 with different lever arms. The difference in lever arm can be obtained either in the area of the journal axes of the levers, or in the area of their support on the drawer-like element or the movable support element.

Figure 9:
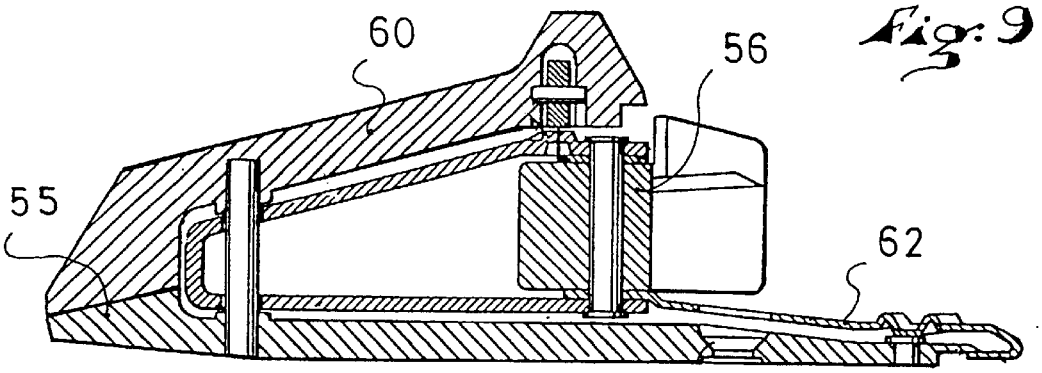
Figure 10:
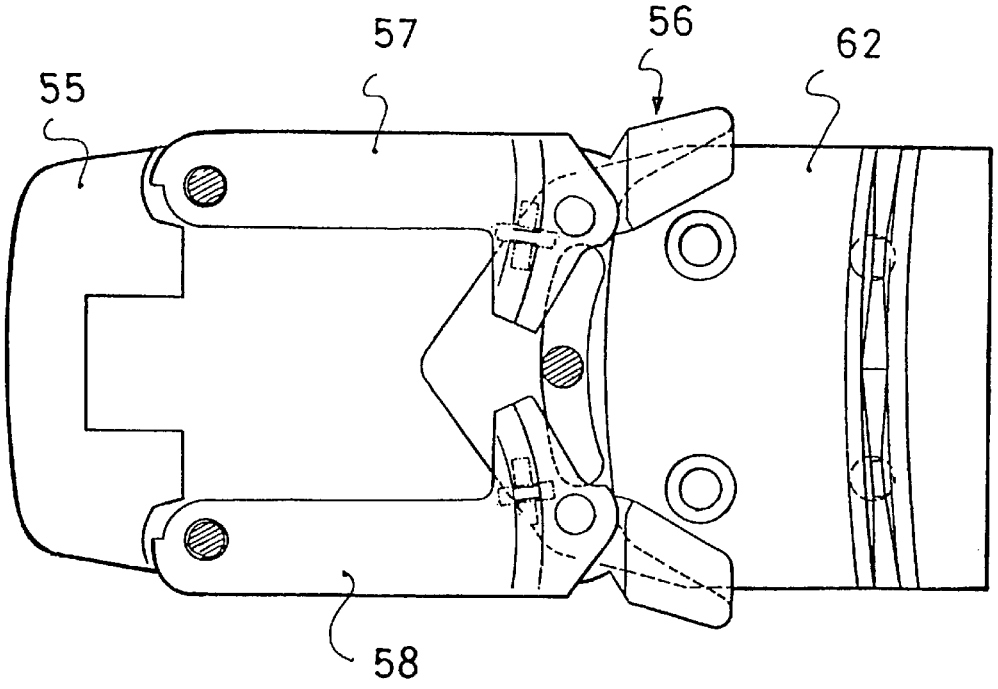

FIGS. 9–11 show another embodiment of the invention and, more specifically, one belonging to the field of construction like that disclosed in the published Patent Application No. WO 85/03451 and U.S. Pat. No. 4,660,849, the disclosure of the latter of which is incorporated by reference thereto in its entirety.

The construction of this front retaining element includes a body 55 provided to be affixed to the ski, and a retaining jaw 56 movable with respect to the body. The jaw is journalled at the end of two arms 57 and 58, which are themselves journalled with respect to the body, such that the four journal points of the arms and of the jaw form the four vertices of a variable quadrangle. The jaw journalled at the end of the arms can move laterally with respect to the body on both sides of a centered position. As shown in FIG. 9, the body covers the arms and a portion of the jaw with a cover 60. A return mechanism, not shown, opposes an elastic resistance to a displacement of the jaw on both sides of this centered position. Furthermore, the jaw includes two lateral wings with an unlocking mechanism that is not shown in the figures. These elements are known, and are secondary with respect to the invention.

The retaining element further includes a support element 62 provided for the boot. The support element 62 is affixedly connected to the jaw 56, and it is laterally movable with the displacements of the jaw.

A set of ramps is further provided between the jaw and the cover, the support element and the body. A first ramp 63 is located between the upper portion of the jaw and the cover 60. In fact, the ramp includes two similar portions, each having two surfaces 63*a*, 63*b*, 63*c*, 63*d*, respectively, converging two by two toward the vertices 63*e*, 63*f*.

When the jaw is in the centered position, aligned with the longitudinal axis of the ski, rollers 64 and 65 mounted on the cover 60 are facing the vertices 63*e* and 63*f* of the ramp. The surfaces 63*a* and 63*c* or 63*b* and 63*d* of the ramp are facing the rollers 64 and 65 depending on the direction of lateral displacement of the jaw.

A second ramp 66 is located between the support element 62 and the portion of the body located beneath the support element. As the preceding ramp, the ramp 66 is made of two similar portions, each including two surfaces, 66*a* and 66*b*, 66*c* and 66*d*, respectively. The surfaces converge two by two toward a recess 66*e*, 66*f*. When the support element is in the centered position, the recesses are opposite the pins 67 and 68 projecting with respect to the upper surface of the body.

In the centered position of the jaw, the rollers 64 and 65 are in contact with the vertices 63*e* and 63*f*, the recesses 66*e* and 66*f* are in contact with the pins 67 and 68. Depending on the direction in which the jaw moves laterally, and depending upon whether the bias exerted by the boot has an upward or downward vertical force, or even a torsional component about a longitudinal axis, a portion of the ramps 64 and/or 65 comes in contact with the rollers or the pins, inducing a lateral component that is added to the lateral force which the boot exerts on the jaw. This lateral component in particular compensates for the friction existing between the boot sole, the jaw, and the support element.

According to the invention, the surfaces of the ramps 64 and 66 have different gradients so that the compensation is more or less active depending on the side where the jaws moves.

Thus, FIG. 11 shows the surfaces 63*a* and 63*c* located on a same side with respect to the roller that is associated therewith, with a steeper gradient than the other surfaces 63*b* and 63*d*.

Similarly, the surfaces 66*a* and 66*c* located on the same side with respect to their associated pin as the surfaces 63*a* and 63*c* have a steeper gradient than the other surfaces 66*b* and 66*d* of the ramp.

Thus, for the same force exerted by the boot on the jaw or the support element, the compensation is more active if the jaw is displaced toward the right side in the figure.

For this embodiment, the relative position of the ramps and of the rollers or pins could be reversed. One could also have only two ramps 63 and 66.

The invention is not limited to a front retaining element. To illustrate this, FIGS. 12 and 13 show a rear retaining element that is said to have a diagonal release. This type of element is disclosed in the published French Patent Application No. 2 138 694 and U.S. Pat. No. 3,876,219, the disclosure of the latter of which is incorporated by reference thereto in its entirety. Such an element is provided to react to a bias of the boot having a direction that is not only vertical but also oblique.

In a known fashion, this element includes a base 70, a retaining jaw 71 carried by a body 72 journalled with respect to the base 70 about a transverse axle 73. The base is further movably mounted so as to rotate about a vertical pivot 75 carried by a plate 76 provided to be affixedly connected to the ski.

On the front, the plate has a fold 78 that has a ramp 79 that extends transversely in its upper portion. The ramp has two surfaces 79*a*, 79*b* that converge toward a slot-shaped central recess 79*c*.

A roller 80 associated with the body 72 is housed in the recess 79*c* when the jaw is in the low retaining position and the body is in the aligned position on the longitudinal axis of the ski.

The vertical movement of the body is guided by a retaining mechanism with threshold that will not be described in detail. When the force exerted by the boot is greater than the retention threshold of the body, the body rises, the roller comes out of the recess 79*c*, thus having the possibility of rolling over one of the surfaces 79*a* or 79*b* depending on the direction in which the boot drives the body.

According to the invention, the surfaces 79*a* and 79*b* have a different gradient, so that the compensation induced by the ramp 79 is more active on one side than on the other.

According to the embodiment shown, the surface 79*b* is more inclined. Concurrently, the edge that demarcates the recess 79*c* is slightly lower on the side of this surface 79*b*, so that the compensation induced by the surface 79*b* is active more quickly in the case of a fall with a diagonal component on this side.

The invention is not limited to the constructional modes described, and numerous variations are possible. In fact, the constructional modes illustrate general features of the invention, including rendering the compensation more or less active depending on the direction of the torsional component of the leg for a retaining element having a jaw movable on either side of a centered position, and a compensating mechanism acting on the opening of the jaw in the case of a torsional force.

Moreover, the invention that has been described could be associated with a retaining element already having, by construction, an asymmetrical release depending on the direction of the torsional force, such that the two effects of asymmetry cumulate.

The instant application is based upon French Patent Application No. 00.04248, filed Mar. 29, 2000, the disclosure of which is hereby incorporated by reference thereto in its entirety, and the priority of which is hereby claimed under 35 U.S.C. §119.

What is claimed is:

1. A retention element for retaining a boot on a ski, said retention element comprising:

a jaw provided to releasably retain one of the ends of a boot on a ski, and an elastic return mechanism for exerting a force toward a centered position aligned with a longitudinal and vertical median plane of the retaining element;

said jaw being laterally movable on either side of said centered position in response to a force having a lateral component oriented in either of two directions against a resistance of said elastic return mechanism; and a compensating mechanism acting on said jaw or said elastic return mechanism so as to further facilitate opening of said jaw, said compensating mechanism comprising a movable support element and two active elements, said movable support element being positioned for engagement with the boot and connecting said jaw or said elastic return mechanism through said two active elements, either of said two active elements being biased as a function of the side to which said jaw moves with respect to the vertical and longitudinal median plane, said two active elements being asymmetrical with respect to the longitudinal and vertical median plane, such that said compensating mechanism is more or less active depending on which of said two active elements is biased as a function of a side on which said jaw moves.

2. An element according to claim 1, wherein said compensating mechanism includes a transverse ramp having at least two surfaces with a different gradients or inclinations.

3. An element according to claim 2, wherein said ramp has two surfaces converging toward a recess, a roller being housed in said recess when said jaw is in said centered position, said recess being limited by two edges of different heights.

4. An element according to claim 1, wherein said compensating mechanism includes two levers that are asymmetrical with respect to the longitudinal and vertical median plane of the element.

5. An element according to claim 1, further comprising a body, said jaw forming an integral assembly with said body, whereby said compensating mechanism acting on said jaw comprises said compensating mechanism acting on said body, said active elements being comprised by ramps of said body.

6. A boot retention device for retaining a boot on a ski, said retention device comprising:

a jaw provided to releasably retain an end of a boot on a ski;

an elastic return mechanism for exerting a force in a direction to move said jaw toward a boot-retention position;

said jaw being mounted for lateral movement on each of opposite sides of said boot-retention position in response to a force having a lateral component oriented in either of two directions against a resistance of said elastic return mechanism; and a compensating mechanism acting on said jaw or on said elastic return mechanism to facilitate release of the boot from said jaw due to forces exerted by the boot on the compensating mechanism during specific types of release movements of the boot during boot release from said jaw, said specific types of release movements of the boot being fewer than all types of release movements of the boot, said compensating mechanism comprising two active elements, each of said two active elements being biased as a function of a respective one of said opposite sides of said boot-retention position to which said jaw moves, said two active elements being constructed to facilitate release of the boot from said jaw asymmetrically with respect to said boot-retention position, whereby release of the boot from said jaw is more greatly facilitated for said lateral movement of said jaw on a first of said opposite sides of said boot-retention position than on a second of said opposite sides of said boot-retention position.

7. A ski boot retention device according to claim 6, wherein said compensating mechanism further comprises a movable support plate, said movable support plate being mounted for movement from a rest position to a lowered releasing position during a movement of the boot during a torsional front fall of a skier, said movable support plate being operatively connected to said jaw or to said elastic return mechanism by means of said two active elements.

8. A ski boot retention device according to claim 6, wherein said two active elements are constituted by two active ramps, said two active ramps having different inclinations with respect to a common reference for more greatly facilitating said lateral movement of said jaw on said first of said opposite sides of said boot-retention position.

9. An element according to claim 8, further comprising a body, said jaw forming an integral assembly with said body, whereby said compensating mechanism acting on said jaw comprises said compensating mechanism acting on said body, said two active ramps being carried by said body.

10. A retention element for retaining a boot on a ski, said retention element comprising:

a jaw provided to releasably retain one of the ends of a boot on a ski, and an elastic return mechanism for exerting a force toward a centered position aligned with a longitudinal and vertical median plane of the retaining element;

said jaw being laterally movable on either side of said centered position in response to a force having a lateral component oriented in either of two directions against a resistance of said elastic return mechanism; and a compensating mechanism acting on said jaw or said elastic return mechanism so as to further facilitate opening of said jaw, said compensating mechanism comprising two active ramps, either of said two active ramps being biased as a function of the side to which said jaw moves with respect to the vertical and longitudinal median plane, said two active ramps being asymmetrical with respect to the longitudinal and vertical median plane, such that said compensating mechanism is more or less active depending on which of said two active ramps is biased as a function of a side on which said jaw moves.

* * * * *